US010240773B1

(12) United States Patent
Francis et al.

(10) Patent No.: US 10,240,773 B1
(45) Date of Patent: Mar. 26, 2019

(54) ACTIVEWEAR VISIBILITY ENHANCEMENT

(71) Applicants: Sidney Francis, Oklahoma City, OK (US); Tiffany Swallow, Oklahoma City, OK (US); Elizabeth Carroll, Oklahoma City, OK (US)

(72) Inventors: Sidney Francis, Oklahoma City, OK (US); Tiffany Swallow, Oklahoma City, OK (US); Elizabeth Carroll, Oklahoma City, OK (US)

( * ) Notice: Subject to any disclaimer, the term of this patent is extended or adjusted under 35 U.S.C. 154(b) by 13 days.

(21) Appl. No.: 15/932,860

(22) Filed: May 9, 2018

(51) Int. Cl.

| | |
|---|---|
| ***A42B 3/04*** | (2006.01) |
| ***A41D 13/01*** | (2006.01) |
| ***F21V 33/00*** | (2006.01) |
| ***F21V 23/00*** | (2015.01) |
| ***F21V 23/04*** | (2006.01) |
| ***F21V 21/08*** | (2006.01) |
| ***F21V 23/06*** | (2006.01) |
| ***G08B 5/00*** | (2006.01) |
| ***A41D 27/20*** | (2006.01) |
| *A41B 1/08* | (2006.01) |
| *F21Y 115/10* | (2016.01) |
| *F21Y 105/10* | (2016.01) |

(52) U.S. Cl.
CPC ..... *F21V 33/0008* (2013.01); *A41D 13/01* (2013.01); *A41D 27/205* (2013.01); *F21V 21/08* (2013.01); *F21V 23/001* (2013.01); *F21V 23/0414* (2013.01); *F21V 23/06* (2013.01); *G08B 5/004* (2013.01); *G08B 5/006* (2013.01); *A41B 1/08* (2013.01); *A41D 2600/104* (2013.01); *F21Y 2105/10* (2016.08); *F21Y 2115/10* (2016.08)

(58) Field of Classification Search
CPC ..... A41D 13/01; A41D 2600/102; A41D 2600/104; B60Q 1/2673; F21V 33/0008; G08B 5/004
See application file for complete search history.

(56) References Cited

U.S. PATENT DOCUMENTS

| | | | | |
|---|---|---|---|---|
| 5,113,325 | A * | 5/1992 | Eisenbraun | A41D 27/085 362/103 |
| 6,106,130 | A | 8/2000 | Harding | |
| 7,048,391 | B2 | 5/2006 | Greves | |
| 8,009,031 | B2 | 8/2011 | Pacheco | |
| 8,616,719 | B1 | 12/2013 | Barze | |
| 9,243,797 | B2 | 1/2016 | Leung | |
| 9,897,299 | B2 | 2/2018 | Dunn | |
| 2002/0145864 | A1* | 10/2002 | Spearing | A41D 13/01 362/103 |
| 2008/0089056 | A1 | 4/2008 | Grosjean | |

(Continued)

*Primary Examiner* — Nimeshkumar D Patel
*Assistant Examiner* — Jacob R Stern
(74) *Attorney, Agent, or Firm* — Randal D. Homburg

(57) ABSTRACT

A reflective base fabric tape is permanently attached to a garment in all directions, the reflective base tape receiving a removably connected linear strip of high visibility LED lighted cable further attached to a local low voltage power supply having a remote on/off switch, the power supply concealing within the garment with the power supply garment extending through an outlet in the garment connecting to the lighted cable, the lighted cable removably detaching from the applied reflective base along with the power supply and switch so that the garment may be laundered and stored within the lighted cable and power supply.

2 Claims, 5 Drawing Sheets

(56) References Cited

U.S. PATENT DOCUMENTS

| | | | | |
|---|---|---|---|---|
| 2010/0253501 | A1 | 10/2010 | Gibson | |
| 2015/0176825 | A1* | 6/2015 | Bernstein | F21V 23/0471 2/93 |
| 2016/0073706 | A1* | 3/2016 | Hartnett | A41D 13/01 315/297 |

* cited by examiner

ACTIVEWEAR VISIBILITY ENHANCEMENT

I. BACKGROUND OF THE INVENTION

1. Field of Invention

A reflective base fabric tape is permanently attached to a garment in all directions, the reflective base tape receiving a removably connected linear strip of high visibility LED lighted cable further attached to a local low voltage power supply having a remote on/off switch, the power supply concealing within the garment with the power supply garment extending through an outlet in the garment connecting to the lighted cable, the lighted cable removably detaching from the applied reflective base along with the power supply and switch so that the garment may be laundered and stored within the lighted cable and power supply.

2. Description of Prior Art

A preliminary review of prior art patents was conducted by the applicant which reveal prior art patents in a similar field or having similar use. However, the prior art inventions do not disclose the same or similar elements as the present visibility enhancement attachment, nor do they present the material components in a manner contemplated or anticipated in the prior art.

In two prior art references, a lighting system is applied to clothing worn by a motorcycle rider which integrates with the signal elements of the motorcycle for lighted signaling on the garment, disclose in U.S. Pat. No. 8,009,031 to Pacheco and U.S. Patent App. No 2010/0253501 to Gibson. No mention is made of a reflective material, local power supply or the ability to disconnect the lighting from the garment. Lighted garments are also demonstrated in a vest having a plurality of embedded lights (non-removable lights from garment) in U.S. Pat. No. 8,616,719 to Barze, safety lighting applied to apparel worn by motorcyclists, bicyclists, road workers or simple entertainment purposes, activated by remote manual controls or sensors in U.S. Patent App. No 2008/0089056 to Grosjean, and a jacket containing strands of LED lights appearing to indicate the lights being supplied from the inside of the garment to pre-determined locations on the outside of the garment, and in U.S. Pat. No. 9,243,797 to Leung, wherein lighted strands of LEDs are installed within seams of the sleeves of a jacket or other garment with a disconnecting inner wiring and power supply, the lights being capable of laundering along with the garment upon removal of the inner cable and power supply. None of these reference any reflective tape incorporated within the scope of their disclosures.

One type of device is indicated having reflective material upon which a plurality of lights are installed, being presented on straps resembling suspenders (actually shown as suspenders) in U.S. Pat. No. 6,106,130 to Harding, with the suspenders attaching to a belt containing a power supply. This device may produce lighting, reflectivity and a local power supply, but is disclosed as having features not included in the present lighted garment and lacing features as included in the present lighted garment thereby providing distinction from this prior art, including removable detachability for laundering between the reflective fabric tape and the lighted strands preventing damage to the lighting elements, application to various body parts other than the areas between the shoulders and waist (including the arms and limbs which move during night activity movements) and applicability of the fabric tape and lighting materials to a garment after purchase.

II. SUMMARY OF THE INVENTION

Night activities can be dangerous if a pedestrian cannot be seen by motor vehicle operators. Reflective materials, light colors, and lights have been worn by pedestrians, motorcyclists and bicycle riders to enhance their visibility for safety reasons in many instances in many garments disclosed in the past. The present active wear visibility enhancement system involves the permanent application of a reflective fabric tape to surfaces of a garment in location which collectively expose the reflective fabric tape to 360 degree visibility on the garment and also includes a detachable high visibility LED lighting cable which connects to the surface of the reflective fabric tape and extends the an unlighted portion of the cable through the garment for connection to a local low-voltage power supply and concealed and secured with the garment, also providing a switch to turn the power supplied to the LED lighting cable on or off. The detachability between the LED lighting cable to remove the cable from the surface of the reflective tape and also to remove withdraw the unlighted portion of the cable and the power supply from the garment, retaining the reflective fabric tape on the garment allows for cleaning and laundering of the garment without detrimental effect on the electronic components.

III. DESCRIPTION OF THE DRAWINGS

The following drawings are submitted with this utility patent application.

IV. DESCRIPTION OF THE PREFERRED EMBODIMENT

Figure 1:
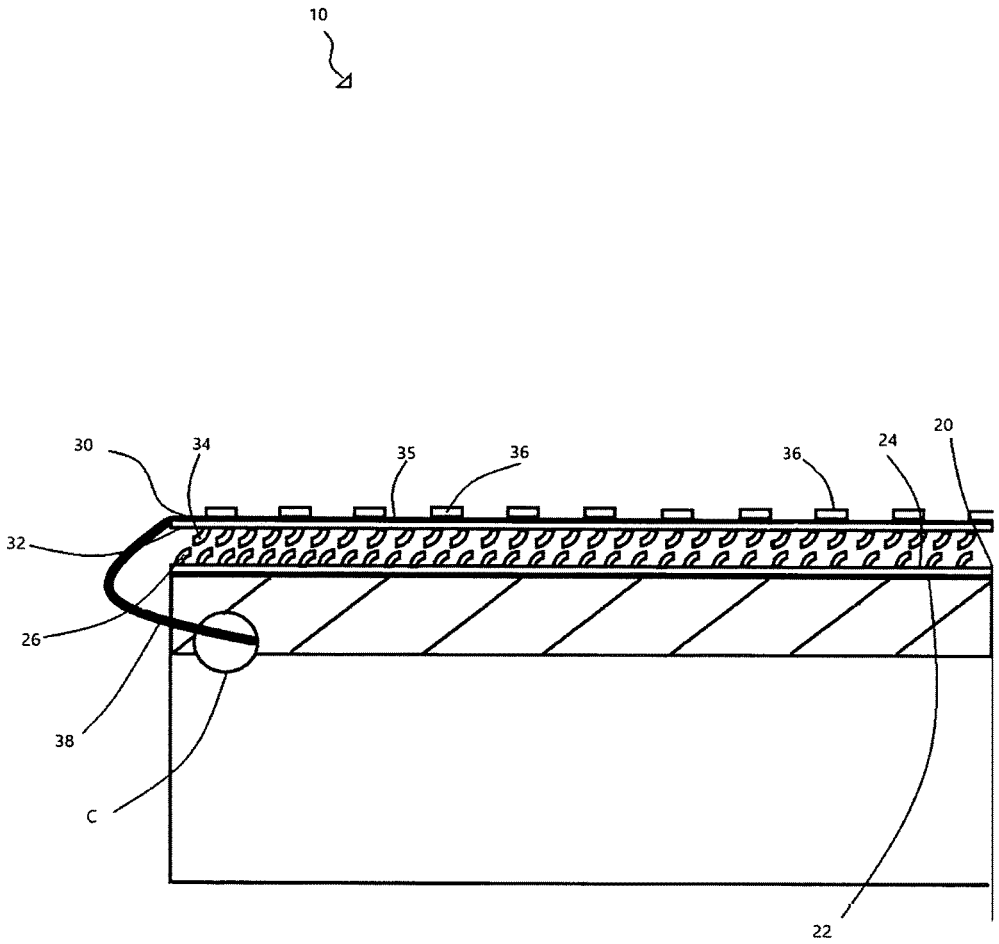
FIG. 1 is a side sectional view of the visibility enhancement materials including the LED lighting material, the reflective base material removably attaching to the LED lighting material, the garment cable port and the fabric base to which the reflective base material is attached or sewn.

A visibility enhancement material 10 attached to a garment A worn by cyclists and pedestrians to improve the visibility of the wearer at night, as shown in FIGS. 1-5 of the drawings provides the visibility enhancement material 10 comprising a base reflective material 20 attached or sewn onto an outer surface B of the garment A, the base reflective material 20 having a fabric rear surface 22, a reflective outer surface 24 and a surface attaching means 26, a layered strip of fabric lighting material 30 providing a lower surface 32 having an opposing surface attaching means 34 which releasably attaches to the surface attaching means 26 of the reflective outer surface base reflective material 20 and an outer surface 35 integrating a plurality of linear aligned LED lights 36 attaching by a common low voltage electrical cable 38, and an inner low voltage power supply 40 attaching to a power cable 42 which removably connects to the low voltage electrical cable 38 connecting the LED lights 36, the low voltage power supply 40 having a power switch 44 with the power cable 42 connected to the low voltage electrical cable 38 by a connecting means 45 with the low voltage electric cable 38 through a garment port C, thereby connecting the low voltage battery power supply 40 provided within a pocket D located within the garment A with the plurality of linear aligned LED lights 36 exposed on the outer surface B of the garment A.

The purpose of the having the layered strip of fabric lighting material 30 releasing from the base reflective material 20 is to remove the fabric lighting material 30 from the garment A for laundering purpose, eliminating the fabric lighting material 30 from exposure to the laundering and drying damage potential. Accordingly, the surface attaching means 26 and the opposing surface attaching means 34 would be best presented as a hook and loop fastening material, snaps, button, hooks or other known fabric attaching means. The low voltage electrical cable 38 may be presented on the outer surface 35 of the fabric lighting material 30 or on the lower surface 32 with the LED lights 38 extending through to the outer surface 35 of the fabric lighting material 30. The connecting means 45, FIG. 5, between the low voltage electrical cable 38 and the power cable 42 would be simple double wire connector known by those skilled in low voltage cable connections and is not unique, other than supplied for connection through, above or below the garment port C so that the low voltage power supply 40 and power cable 42 can be removed at the same time the fabric lighting material 30 is removed from the garment A prior to laundering. The low voltage power supply 40 is best presented as a 1.5-9 volt battery which is adapted to operate the plurality of linear aligned LED lights 38, FIG. 5. The LED lights 38 may be monochromatic or multiple colors. As an option, the low voltage power supply 40 may also provide a selection switch to provide the LED lights 38 to illuminate in patterns similar to Christmas lighting.

Figure 2:
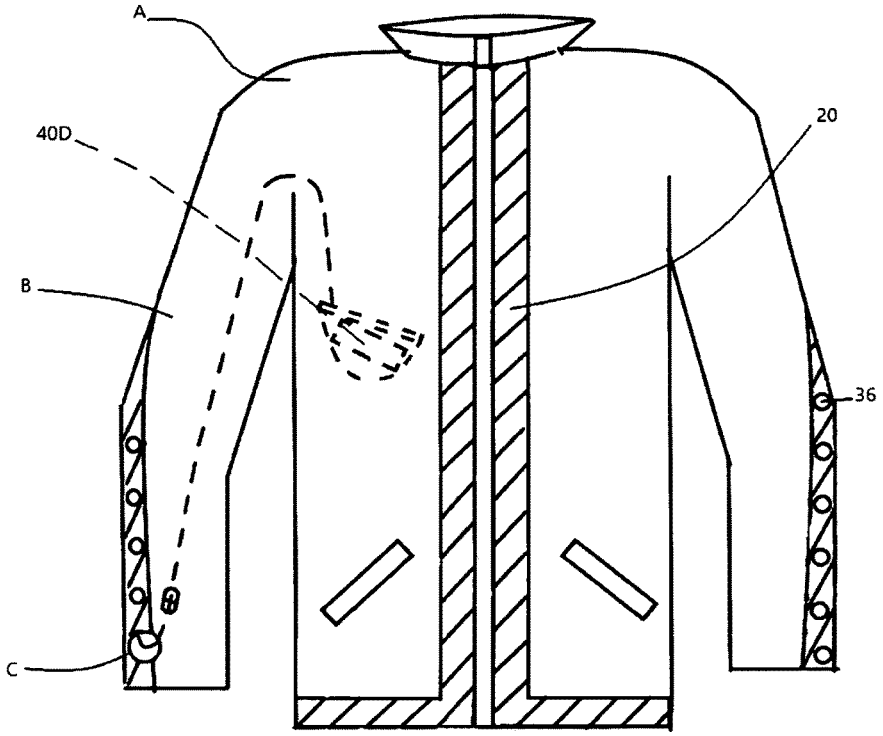
FIG. 2 is a front view of an exercise jacket including the visibility enhancement materials, with phantom lines indicating the electrical wiring and the low voltage battery supply to illuminate the LED lighting materials.
Figure 3:
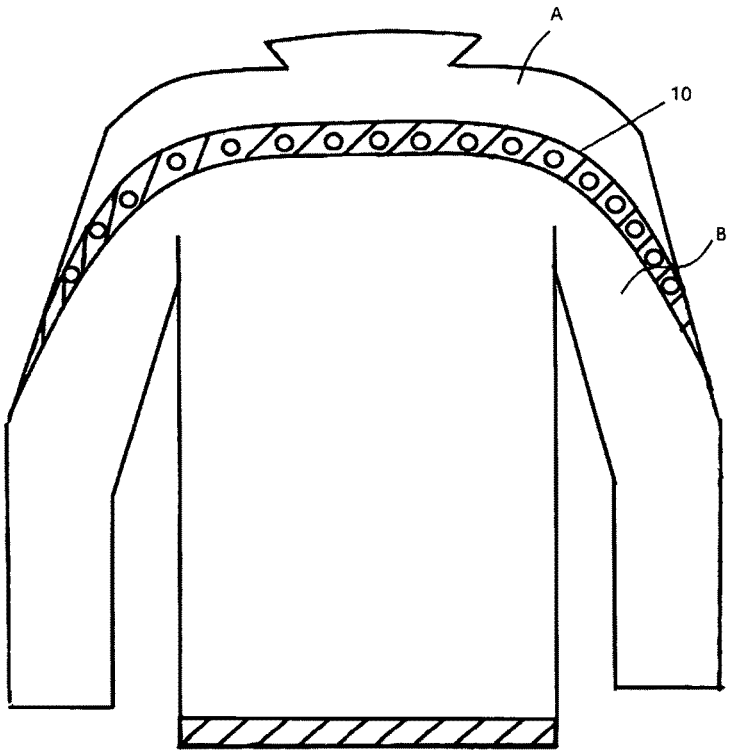
FIG. 3 is a rear view of the exercise jacket of FIG. 2.
Figure 4:
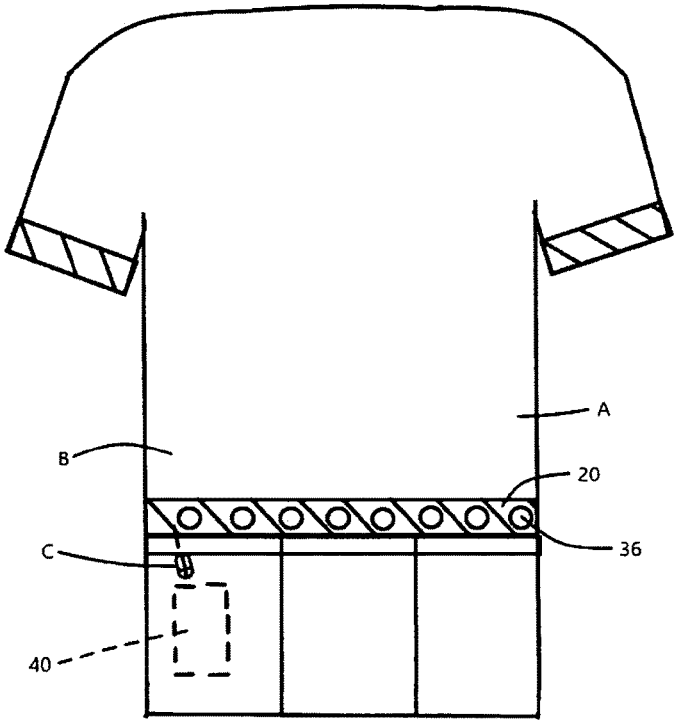
FIG. 4 is a view of another garment applying the visibility enhancement materials including the low voltage battery supply.
Figure 5:
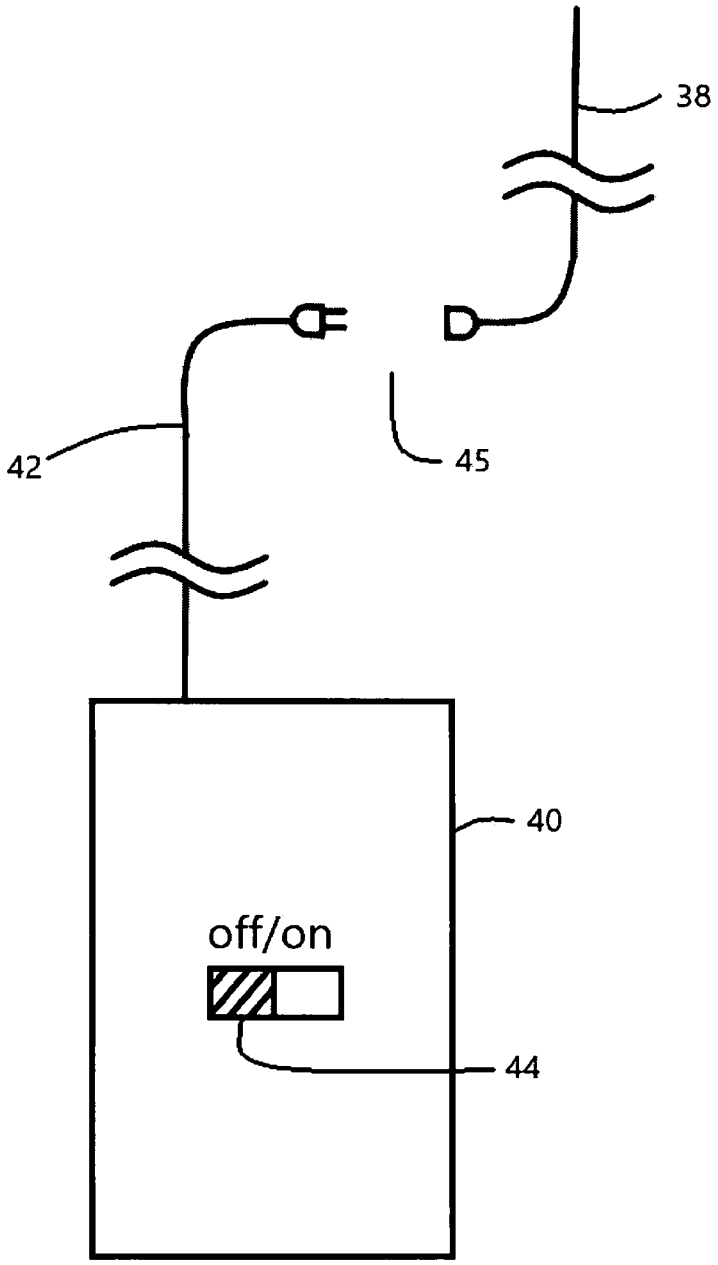
FIG. 5 is a view of the power supply and electrical wiring.

It is recommended that the placement of the visibility enhancement material 10 would be on more than one outer surface B of the garment A and preferably applied to part of the garment A that moves during wear, including arms, FIGS. 2-4, or legs in pants or shorts, not shown, but contemplated within the scope of the range of garment A to which the visibility enhancement materials 10 can be applied. While use and presentation of the visibility enhancement material 10 embodiments have been particularly shown and described with reference to a preferred embodiment thereof, it will be understood by those skilled in the art that changes in form and detail may be made therein without departing from the spirit and scope of the invention.

What is claimed is:

1. A visibility enhancement material attached to a garment worn by cyclists and pedestrians to improve the visibility of the wearer at night, said visibility enhancement material comprising:

a base reflective material sewn or otherwise onto an outer surface of said garment, said base reflective material defining a fabric rear surface, a reflective outer surface and a surface attaching means;

a layered strip of fabric lighting material defining a lower surface presenting an opposing surface attaching means which releasably attaches to said surface attaching means of said reflective outer surface base reflective material and an outer surface integrating a plurality of linear aligned LED lights attaching by a common low voltage electrical cable; and an inner low voltage power supply attaching to a power cable removably connecting to said low voltage electrical cable connecting said LED lights, said low voltage power supply having a power switch, and said power cable connecting to said low voltage electrical cable by a connecting means with said low voltage electric cable threading through a garment port in said garment, thereby connecting said low voltage battery power supply within a pocket located within said garment with said plurality of linear aligned LED lights illuminating on said outer surface of said garment enhancing said visibility of said cyclist or pedestrian.

2. The visibility enhancement material of claim 1, wherein:

said surface attaching means and said opposing surface attaching means are selected from a list including a hook and loop fastening material, snaps, button, or hooks; and said connecting means between said low voltage electrical cable and said power cable is simple double wire connector supplied for connection through, above or below said garment port so that said low voltage power supply and said power cable can be removed at the same time said fabric lighting material is removed from said garment prior to laundering.

* * * * *